United States Patent [19]

Takahashi et al.

[11] 4,437,445

[45] Mar. 20, 1984

[54] METHOD AND APPARATUS FOR CONTROLLING THE FUEL FEEDING RATE OF AN INTERNAL COMBUSTION ENGINE

[75] Inventors: Hiroshi Takahashi; Yukio Suzuki; Masashi Matsuo; Hironobu Ono, all of Toyota; Shuzo Yoshida, Anjo; Kazuo Ueda, Kariya; Motoharu Sueishi, Toyota, all of Japan

[73] Assignees: Toyota Jidosha Kabushiki Kaisha, Toyota; Nippondenso Co., Ltd., Kariya, both of Japan

[21] Appl. No.: 407,562

[22] Filed: Aug. 12, 1982

[30] Foreign Application Priority Data

Aug. 13, 1981 [JP] Japan ..... 56-125984

[51] Int. Cl.[3] ..... F02D 5/00

[52] U.S. Cl. ..... 123/491; 123/179 G

[58] Field of Search ..... 123/491, 179 G, 179 L

[56] References Cited

U.S. PATENT DOCUMENTS

| | | | |
|---|---|---|---|
| 4,114,570 | 9/1978 | Marchak et al. | 123/491 |
| 4,148,283 | 4/1979 | Harada et al. | 123/491 |
| 4,184,460 | 1/1980 | Harada et al. | 123/491 |
| 4,239,022 | 12/1980 | Drews et al. | 123/491 |

*Primary Examiner*—Andrew M. Dolinar

*Attorney, Agent, or Firm*—Cushman, Darby & Cushman

[57] ABSTRACT

During starting of an engine, enrichment correction according to engine starting enrichment is executed. After starting of the engine, enrichment correction is transferred gradually with the lapse of time from starting enrichment to normal warm-up enrichment. The transfer speed from starting enrichment to normal warm-up enrichment is changed depending upon whether a throttle valve is in an idle position or not.

9 Claims, 11 Drawing Figures

30
72
MPU
82
78
RAM
80
ROM
76
I/O
70
ADC
74
I/O
26a
INJECTION VALVE
26b
INJECTION VALVE
26c
INJECTION VALVE
26d
INJECTION VALVE
40
48
38
39
52
56
18
AIR-FLOW SENSOR
46
COOLANT-TEMPERATURE SENSOR
36
CRANK-ANGLE SENSOR
37
CRANK-ANGLE SENSOR
50
THROTTLE SWITCH
54
STARTER SWITCH

METHOD AND APPARATUS FOR CONTROLLING THE FUEL FEEDING RATE OF AN INTERNAL COMBUSTION ENGINE

BACKGROUND OF THE INVENTION

The present invention relates to a method and apparatus for controlling the fuel-feeding rate of an internal combustion engine during starting of and for a period of time after starting of the engine.

In an internal combustion engine of the electronic fuel-injection control type having fuel-injection valves or of the electronic carburetor-control type having an electronically controlled carburetor, not only is a normal warm-up enrichment operation for increasing the fuel-feeding rate depending upon the warm-up condition of the engine executed but an engine-starting enrichment operation for additionally increasing the fuel-feeding rate during starting (cranking) is also executed. After starting of the engine, the above-mentioned additional increment according to the starting-enrichment operation is gradually decreased to zero with the lapse of time. Thereafter, normal warm-up enrichment is executed. These enrichment operations (hereinafter referred to as two-characteristic enrichment) are already known by, for example, SAE paper No. 740,020, pages 237 to 244.

During starting of and for a period of time after starting of the engine, since the temperature of the inner wall in the combustion chamber is low, the engine requires a rich air-fuel mixture in order for good operating characteristics to be obtained. Therefore, during starting of and for a while after starting of the engine, the above starting-enrichment operation is carried out. However, since the inner wall temperature rises faster than the coolant temperature, which is, in general, used for detecting the warm-up condition of the engine, the starting-enrichment operation need not be executed until the engine is fully warmed-up. Therefore, after starting of the engine, the starting increment of the fuel-feeding rate is gradually decreased to zero and thereafter fuel increment according to the normal warm-up enrichment operation is executed, causing the emission control characteristics to improve. In other words, the aforementioned two-characteristic enrichment is, thus, executed.

However, according to conventional two-characteristic enrichment, since the speed decrease of the additional fuel increment according to the engine starting-enrichment operation after starting of the engine is always constant, the starting enrichment does not correctly respond to the inner wall temperature of the combustion chamber. In other words, according to the conventional enrichment, the difference of the inner wall temperature, which difference is caused by the difference of the operating condition of the engine after starting, is completely ignored.

SUMMARY OF THE INVENTION

It is, therefore, an object of the present invention to provide a method and apparatus for controlling the fuel-feeding rate of an internal combustion engine, whereby the most suitable starting enrichment can be executed, with the result that the emission control characteristics, namely the pollution reduction performance, are extremely improved.

According to the present invention, a method for controlling the fuel-feeding rate of an internal combustion engine having a throttle valve comprises the steps of: detecting the warm-up condition of the engine to generate a first electrical signal which indicates the detected warm-up condition; detecting whether the engine is starting or is not starting to generate a second electrical signal which indicates the detected result; detecting whether the throttle valve is in the idle position or not in the idle position to generate a third electrical signal which indicates the detected result; calculating, in response to the first electrical signal, a first additional increment of the fuel-feeding rate of the engine, the first additional increment being determined depending upon the detected warm-up condition; calculating, in response to the second and third electrical signals, a second additional increment of the fuel-feeding rate of the engine, the second additional increment, after starting of the engine, being decreased to zero with the lapse of time, the speed decrease of the second additional increment being changed depending upon the third electrical signal; and correcting the fuel feeding rate of the engine in accordance with the calculated first and second additional increments.

Furthermore, according to the present invention, an apparatus for controlling the fuel-feeding rate of an internal combustion engine having a throttle valve and a starter switch comprises: means for detecting the warm-up condition of the engine to generate a first electrical signal which indicates the detected warm-up condition; first circuit means for producing a warm-up increment signal depending upon the first electrical signal; second circuit means for producing a starting increment signal of a fixed value when the starter switch is closed and for producing a starting increment signal which decreases with the lapse of time when the starter switch is open; means for additionally increasing the fuel-feeding rate of the engine in response to the warm-up increment signal and the starting increment signal; throttle position-sensing means for detecting the position of the throttle valve to generate a second electrical signal when the throttle valve is in the idle position; and third circuit means for changing the speed decrease of the starting increment signal after engine starting to a lower speed when the second electrical signal is generated in comparison with the speed when the second electrical signal is not generated.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
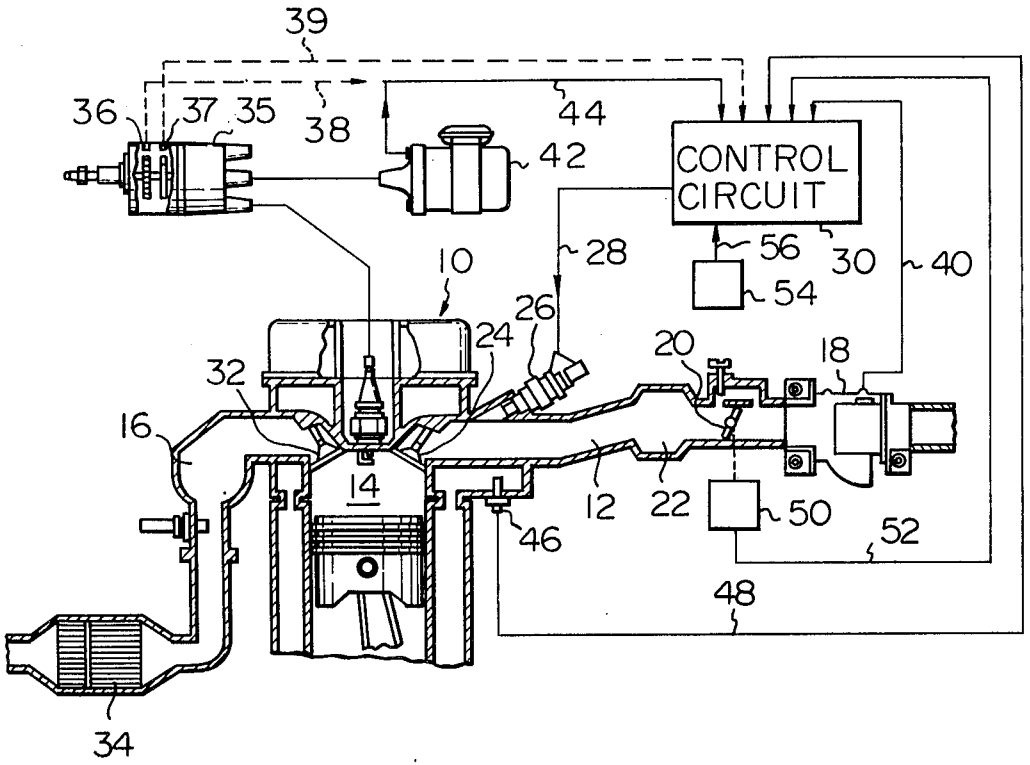
FIG. 1 is a schematic diagram illustrating an electronic fuel-injection control system according to the present invention.

In FIG. 1, reference numeral 10 denotes an engine body, 12 an intake passage, 14 a combustion chamber, and 16 an exhaust passage. The flow rate of intake air introduced through an air cleaner, which is not shown, is measured by an air-flow sensor 18. The intake-air flow rate is controlled by a throttle valve 20 interlocked with an accelerator pedal which is not shown. The intake air passing through the throttle valve 20 is introduced into the combustion chamber 14 via a surge tank 22 and an intake valve 24.

Each of fuel-injection valves (fuel-injectors) 26 for the respective cylinders is opened and closed in response to electrical drive pulses that are fuel fed from a control circuit 30 via a line 28. The fuel-injection valves 26 intermittently inject into the intake passage 12 in the vicinity of the intake valve 24 pressurized fuel which is supplied from a fuel supply system which is not shown.

The exhaust gas which is formed due to combustion in the combustion chamber 14 is emitted via an exhaust valve 32, the exhaust passage 16, and a catalytic converter 34.

The air-flow sensor 18 is disposed in the intake passage 12 at a position upstream of the throttle valve 20 to detect the intake-air flow rate. The detection signal from the air-flow sensor 18 is fed to the control circuit 30 via a line 40.

If the control circuit 30 is formed by an analog-type electronic circuit, primary ignition signals from the primary winding of an ignition coil 42 are fed to the control circuit 30 via a line 44. If the control circuit 30 is formed by a digital-type electronic circuit, pulse signals from crank angle sensors 36 and 37 installed in a distributor 35 are used instead of the primary ignition signals. The crank angle sensors 36 and 37 produce pulse signals at every crank angle of 30° and 720°, respectively. The pulse signals produced at every crank angle of 30° are fed to the control circuit 30 via a line 38, and the pulse signals produced at every crank angle of 720° are fed to the control circuit 30 via a line 39.

A coolant-temperature sensor 46 detects the temperature of the coolant in the engine. The output signal from the coolant-temperature sensor 46 is fed to the control circuit 30 via line 48.

A throttle-position switch 50 which is interlocked with the throttle valve 20 detects whether the throttle valve 20 is in the fully closed position or not. The output signal from the throttle-position switch 50 is fed to the control circuit 30 via a line 52.

The signal from a starter switch 54, which signal indicates whether the engine is cranking or not, is fed to the control circuit 30 via a line 56.

Figure 2:
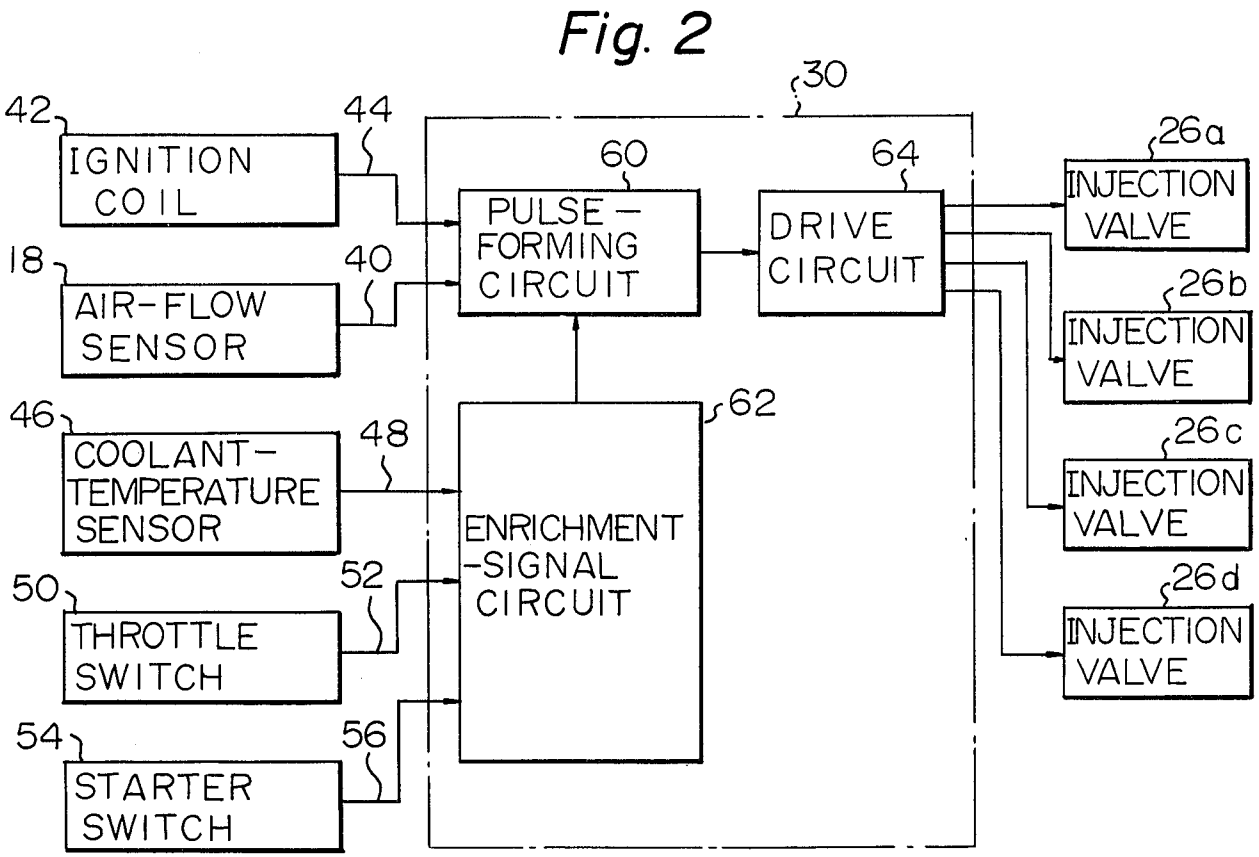
FIG. 2 is a block diagram illustrating an example of the control circuit shown in FIG. 1.

FIG. 2 illustrates an analog-type electronic circuit as an example of the control circuit 30 shown in FIG. 1. In FIG. 2, the ignition coil 42, air-flow sensor 18, coolant-temperature sensor 46, throttle-position switch 50, and starter switch 54 illustrated in FIG. 1 are represented by blocks, respectively. Furthermore, the fuel-injection valves for the respective cylinders (four cylinders) are represented by blocks 26*a*, 26*b*, 26*c*, and 26*d*.

The primary ignition signals from the ignition coil 42 and the intake-air flow-rate signal from the air-flow sensor 18 are fed to a pulse-forming circuit 60. The pulse-forming circuit 60 first produces basic pulses having a pulse width of $\tau_B$ which is equivalent to K·(Q/N), where K is a constant, Q the intake-air flow rate, and N the rotational speed (rpm) of the engine. These basic pulses are formed by controlling the charge time of a charge-discharge capacitor in response to the time interval of the primary ignition signal and by controlling the discharge current of the charge-discharge capacitor in response to the intake-air flow-rate signal. The pulse-forming circuit 60 finally produces fuel-injection pulses having a pulse width of $\tau$, which pulses regulate the quantity of fuel metered to the engine for a given piston stroke. The fuel-injection pulses are produced by correcting the pulse width of $\tau_B$ of the basic pulses in accordance with an enrichment-correction signal fed from an enrichment signal circuit 62. The above correction of the pulse width is executed by controlling the charge and discharge currents of the charge-discharge capacitor in response to the enrichment-correction signal. Since the above-mentioned pulse-forming circuit is well-known, a detailed explanation thereof is omitted in this specification.

The fuel-injection pulses from the pulse-forming circuit 60 are fed to a drive circuit 64 to form a drive current for energizing the fuel-injection valves 26*a* to 26*d*. In response to the drive current, the fuel-injection valves 26*a* to 26*d* inject into the engine a quantity of fuel corresponding to the pulse width of $\tau$ of the fuel-injection pulses.

The enrichment-signal circuit 62 produces an enrichment-correction signal in accordance with signals from the coolant-temperature sensor 46, throttle-position sensor 50, and starter switch 54.

Figure 3:
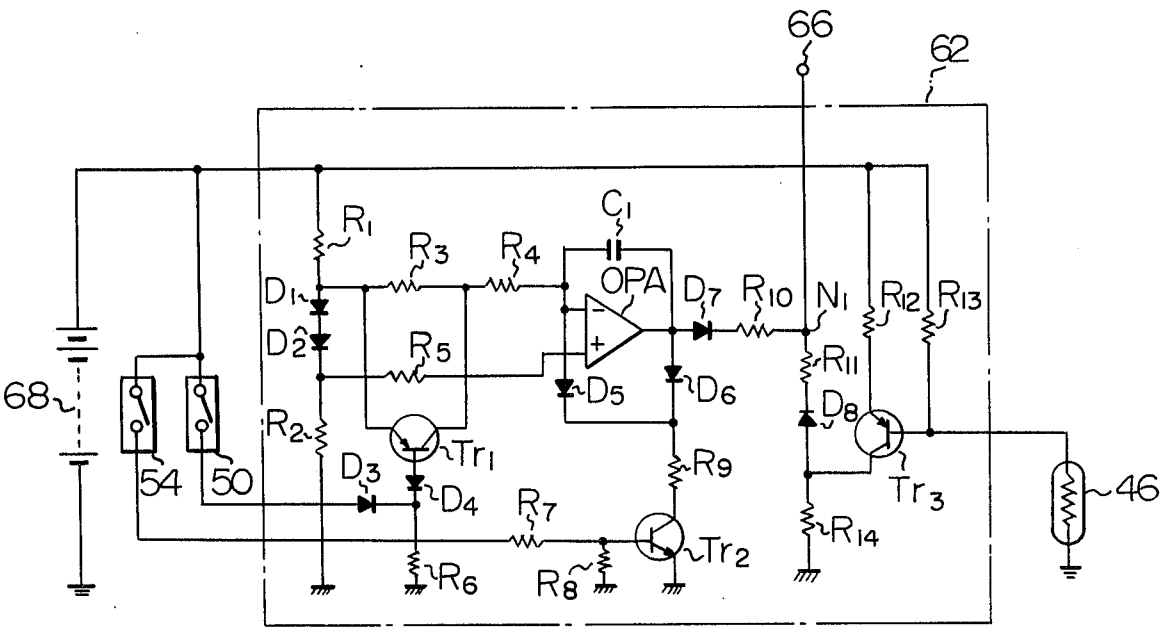
FIG. 3 is a circuit diagram illustrating the enrichment-signal circuit shown in FIG. 2.

In FIG. 3, if the resistance of the coolant-temperature sensor 46, which is composed of a thermistor, changes depending upon the engine-coolant temperature, the potential at the base of a transistor $Tr_3$ changes, and, thus, the potential at the collector of the transistor $Tr_3$ changes. Accordingly, the enrichment-correction signal fed to the pulse-forming circuit 60 via a terminal 66 is controlled depending upon the coolant temperature. That is, the enrichment-correction signal is controlled in accordance with the coolant temperature to normal warm-up enrichment amount $WL_N$ shown in FIG. 4.

During cranking, since the starter switch 54 closes, a transistor $Tr_2$ turns on, causing the potentials across an integration capacitor $C_1$ of the integrator with an operational amplifier OPA to be equal to each other. That is, the output of the integrator is held to an initial value during cranking. The initial value is determined according to the voltage $V_B$ across the battery 68, the resistances $R_1$ and $R_2$ of respective resistors $R_1$ and $R_2$, and the forward resistance $R_f$ of diodes $D_1$ and $D_2$ for forming the input voltage of the integrator. Namely, the initial value is determined from $$\frac{V_B \cdot R_2}{R_1 + 2R_f + R_2}$$

The output from the integrator is fed to a node $N_1$ via a diode $D_7$ and a resistor $R_{10}$ so that it is added to the aforementioned signal fed via a resistor $R_{11}$ and a diode $D_8$, which signal corresponds to normal warm-up enrichment amount $WL_N$. Therefore, the enrichment correction signal which appears at the terminal 66 during cranking changes in accordance with the coolant temperature to starting-enrichment amount $WL_{ST}$ shown in FIG. 4.

When the starter switch 54 opens, the transistor $Tr_2$ turns off, causing the integrator to start the integration operation. Thus, the output of the integrator (which output corresponds to the starting-additional increment) is gradually decreased with the lapse of time. When the throttle-position switch 50 is on, since a transistor $Tr_1$ is off, the integration time constant of the integrator is equal to $C_1 \cdot (R_3 + R_4)$. In this case, the output $V_o$ of the integrator is indicated as follows:

$$V_o = \frac{V_B \cdot R_2}{R_1 + 2R_f + R_2} - \frac{2}{C_1 \cdot (R_3 + R_4)} \int V_f dt$$

where $V_f$ is the forward voltage drop of the diodes $D_1$ and $D_2$.

On the other hand, when the throttle position switch 50 is off, the transistor $Tr_1$ is on. Therefore, the resistor $R_3$ is shortened, causing the integration time constant to be equal to $C_1R_4$. In this case, the output $V_o$ of the integrator is indicated as follows:

$$V_o = \frac{V_B \cdot R_2}{R_1 + 2R_f + R_2} - \frac{2}{C_1 \cdot R_4} \int V_f dt$$

As will be apparent from the above equation, the speed decrease of the starting-additional increment when the throttle-position switch 50 is on is higher than the speed decrease of the starting-additional increment when the throttle-position switch 50 is off. In other words, the speed decrease of the starting-additional increment during the engine idle condition of the deceleration condition is lower than that during other operating conditions of the engine. Namely, when a large quantity of heat is generated and the inner wall temperature of the combustion chamber rises quickly, the speed decrease of the starting-additional increment, in other words, the transfer speed from the starting-enrichment characteristics of $WL_{ST}$ to the normal warm-up enrichment characteristics of $WL_N$ shown in FIG. 4, is set at high.

After starting, if the output of the integrator decreases to below the voltage at the node $N_1$, which voltage is fed from the coolant-temperature sensor 46 side, the diode $D_7$ turns off. Thereafter, the normal warm-up enrichment operation is executed.

Figure 4:
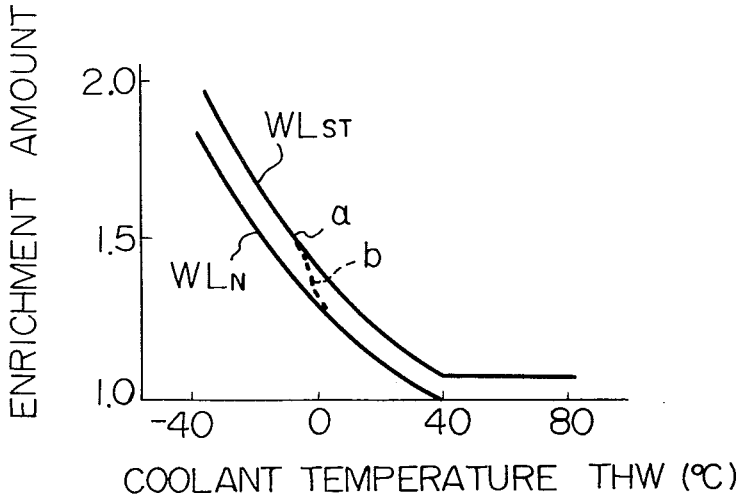
FIG. 4 is a graph of the enrichment amounts versus the coolant temperatures.
Figure 5:
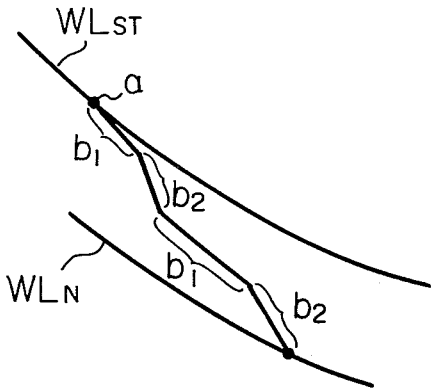
FIG. 5 is a partly enlarged graph of FIG. 4.

According to the above-mentioned embodiment, the starting-enrichment operation in accordance with the coolant temperature-dependent characteristics of $WL_{ST}$ of FIG. 4 is carried out during starting of the engine. When engine starting is over at point a shown in FIG. 4, the enrichment operation gradually transfers with the lapse of time from the starting-enrichment characteristics of $WL_{ST}$ to the normal warm-up enrichment characteristics of $WL_N$, as shown by a broken line b. This transfer speed is changed depending upon whether or not the throttle valve 20 is in the idle position, as shown in FIG. 5. That is, in FIG. 5, when the throttle valve 20 is in the idle position and, thus, the throttle-position switch 50 is on, the transfer speed is low, as shown by $b_1$. Contrary to this, when the throttle valve 20 is in another position, the transfer speed is high, as shown by $b_2$.

Figures 6A, 6B:
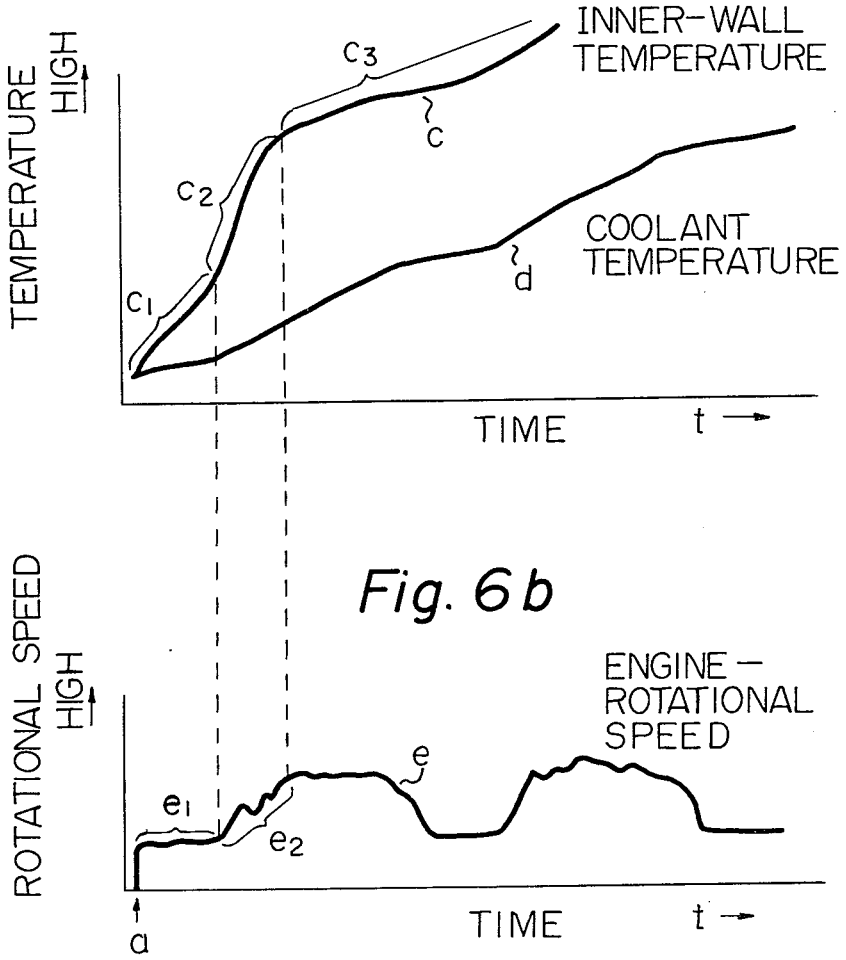
FIGS. 6*a* and 6*b* are graphs illustrating the operation and effect of the present invention.

FIGS. 6*a* and 6*b* illustrate the relationship between inner-wall temperature c of the combustion chamber, coolant temperature d, and rotational speed e of the engine after starting of the engine. If the starting operation is over at a and the engine is idling for period $e_1$, inner-wall temperature c slowly rises, as shown by $c_1$. However, if the engine-rotational speed increases to higher than the idle speed, as shown by $e_2$, the inner-wall temperature of the combustion chamber rapidly rises, as shown by $c_2$. Therefore, while the engine rotates at a speed different from the idle speed, even if the speed decrease of the starting-additional increment is made to be fast so as to control the air-fuel ratio so that it is on the lean side, the operating characteristics of the engine are not unfavorably affected and a good pollution reduction performance can be obtained.

In region $c_3$ where the inner-wall temperature of the combustion chamber is somewhat high, the inner-wall temperature depends only upon the coolant temperature. Therefore, in region $c_3$, the normal warm-up enrichment operation according to the characteristics of $WL_N$ shown in FIG. 4 is executed.

Figure 7:
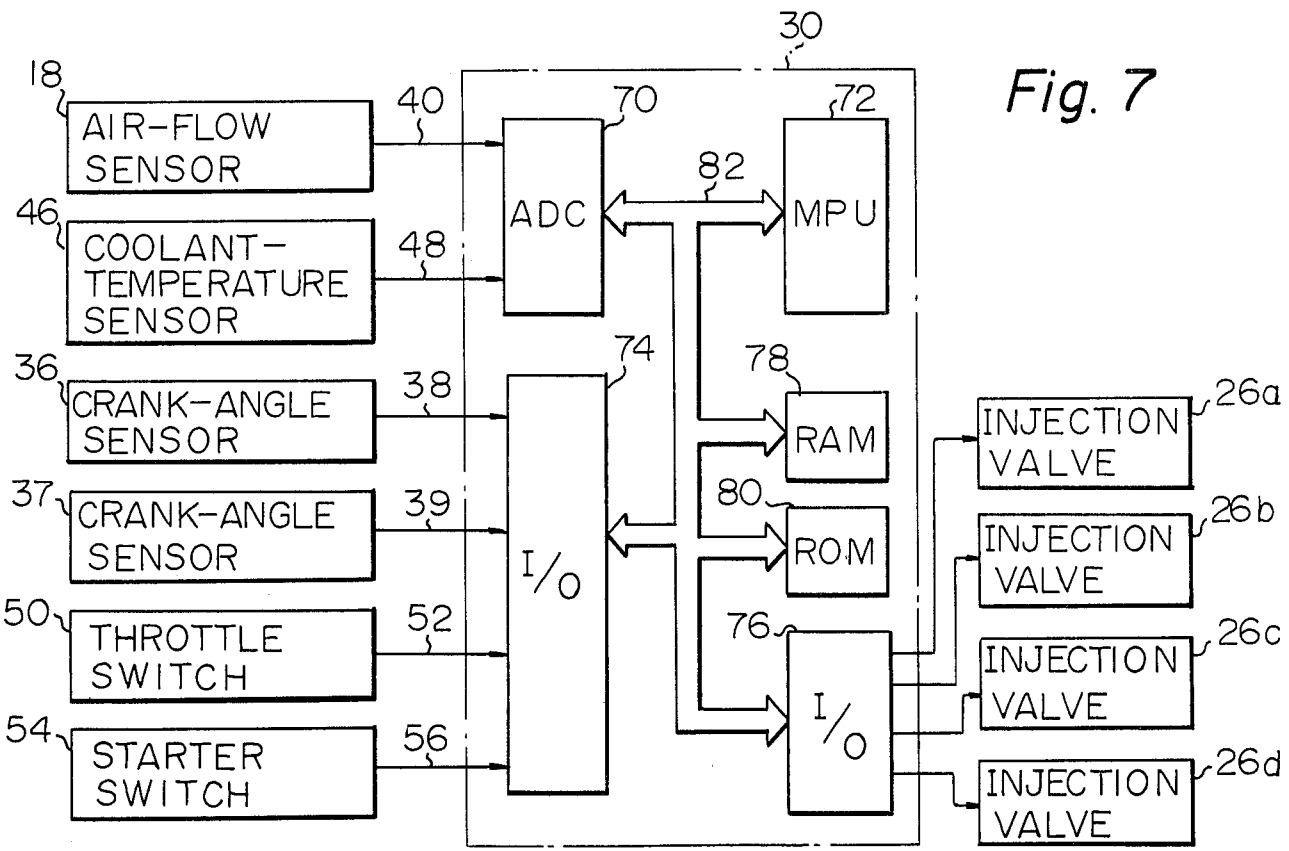
FIG. 7 is a block diagram illustrating another example of the control circuit shown in FIG. 1.

FIG. 7 illustrates a digital-type electronic circuit having a microcomputer as another example of the control circuit 30 shown in FIG. 1. In this example, pulse signals from the crank-angle sensors 36 and 37 are used instead of the primary ignition signal from the ignition coil 42.

In FIG. 7, signals from the air-flow sensor 18 and coolant-temperature sensor 46 are fed to an analog-to-digital (A/D) converter 70, which contains an analog multiplexer, and are sequentially converted into signals in the form of binary numbers in response to instructions from a microprocessor unit (MPU) 72.

The pulse signals produced by the crank-angle sensor 36 at every crank angle of 30° are fed to an rpm-signal former circuit constructed in an input-output unit (I/O unit) 74 to produce an engine-rpm signal in the form of a binary number. The pulse signals produced by the crank-angle sensor 37 at every crank angle of 720° are fed to the I/O unit 74 and are used to produce interrupt request signals for fuel injection pulse-width calculation and fuel-injection start signals.

Signals from the throttle-position switch 50 and starter switch 54 having the level of "1" or "0" are fed to the I/O unit 74 and are stored therein for some time. A fuel-injection control circuit having a down counter which can be preset and a resister is constructed in an I/O unit 76. The fuel-injection control circuit receives binary output data indicative of the calculated fuel-injection pulse width of $\tau$ from the MPU 72 and produces fuel-injection pulses having a pulse width of $\tau$. The fuel-injection pulses are fed to the fuel-injection valves 26*a* to 26*d* via drive circuits (not shown). The fuel-injection valves 26*a* to 26*d* thus inject into the engine a quantity of fuel corresponding to the pulse width of $\tau$ of the fuel-injection pulses.

The A/D converter 70 and I/O units 74 and 76 are connected via a bus 82 to the MPU 72, a random access memory (RAM) 78, and a read only memory (ROM) 80 which constitute the microcomputer. Via the bus 82, the data are transferred.

The ROM 80, there is stored beforehand a program for main routine, an interrupt routine for the arithmetic calculation of the fuel-injection pulse width, other routine, and various data that are necessary for carrying out arithmetic calculation, for example, map data of enrichment factors $WL_N$ and $WL_{ST}$ with respect to coolant temperature THW.

Hereinafter, the operation of the microcomputer will be illustrated with reference to the flow diagrams of FIGS. 8 and 9.

In the main processing routine, the MPU 72 introduces a binary rpm signal, which indicates the rotational speed N of the engine, from the I/0 unit 74 and stores the rpm signal in the RAM 78. The MPU 72 further introduces a binary signal which indicates intake-air flow rate Q and a binary signal which indicates coolant temperature THW from the A/D converter 70 in response to the interrupt request which occurs at every completion of A/D conversion. Then the MPU 72 stores the introduced binary signals in the RAM 78.

Figure 8:
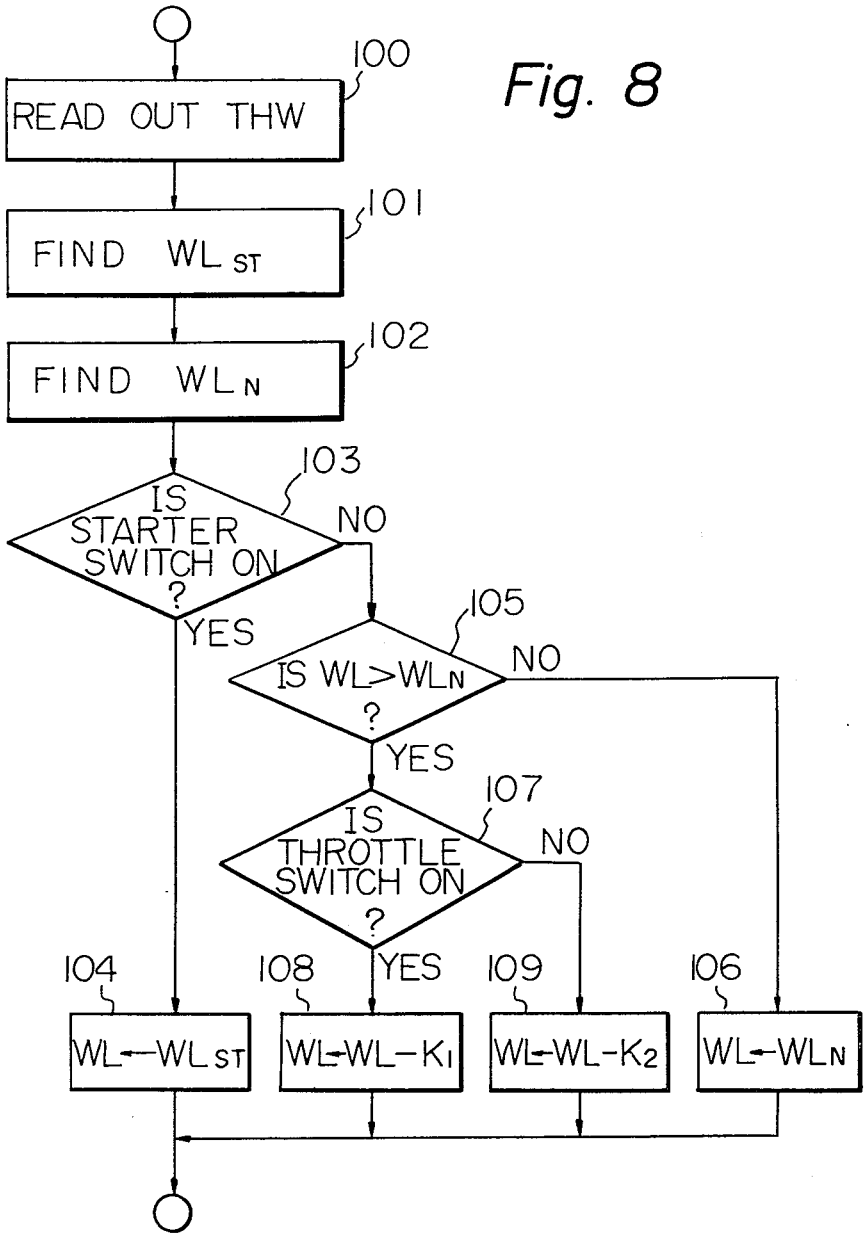
FIGS. 8 and 9 are flow diagrams of control programs of the control circuit shown in FIG. 7.

The MPU 72 executes the processing shown in FIG. 8 during the main processing routine. It is preferable that the processing routine of FIG. 8 be executed once after the new binary signal with respect to coolant temperature THW is introduced from the A/D converter 70.

Figure 10:
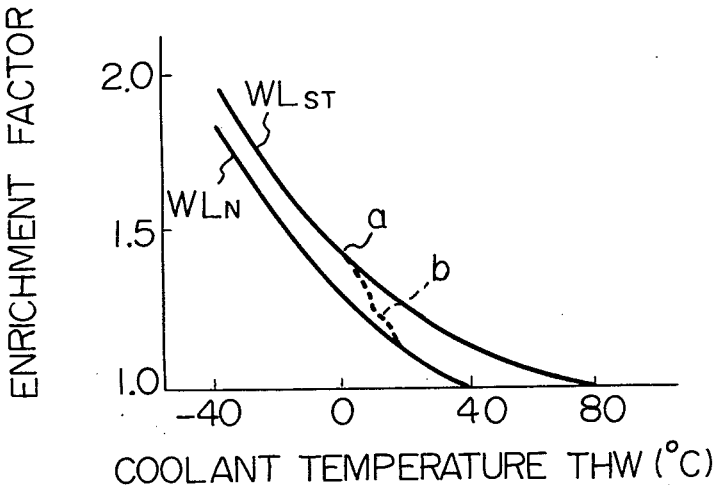
FIG. 10 is a graph of the enrichment factors versus the coolant temperatures.

At point 100 in the processing of FIG. 8, the MPU 72 reads out coolant-temperature data THW from the RAM 78. Then, at points 101 and 102, the MPU 72 finds starting-enrichment factor $WL_{ST}$ and normal warm-up enrichment factor $WL_N$ depending upon coolant-temperature data THW, by using the THW-$WL_{ST}$ map and the THW-$WL_N$ map. In the ROM 80 are stored beforehand the relationship between starting-enrichment factor $WL_{ST}$ and coolant temperature THW and the relationship between normal warm-up enrichment factor $WL_N$ and coolant temperature THW, as shown in FIG. 10 in the form of the THW-$WL_{ST}$ map and the THW-$W_N$ map. In these processings, interpolation is used if necessary.

At point 103, the MPU 72 discriminates whether the starter switch 54 is on or off. When it is discriminated that starter switch 54 is on, namely, that the engine is starting, the program proceeds to point 104 where enrichment-correction factor WL is equalized with starting-enrichment factor $WL_{ST}$ obtained at point 102. Then enrichment-correction factor WL is stored in the RAM 78. If it is discriminated, at point 103, that starter switch 54 is off, namely, that the engine is not starting, the program proceeds to point 105. At point 105, the MPU 72 discriminates whether or not present enrichment-correction factor WL is larger than normal warm-up enrichment factor $WL_N$ obtained at point 101. If $WL \leqq WL_N$, WL is equalized with $WL_N$ at point 106 and then equalized WL is stored in the RAM 78. According to processing at points 105 and 106, enrichment-correction factor WL is regulated so that it is not smaller than $WL_N$. If it is discriminated, at point 105, that WL is larger than $WL_N$, the program proceeds to point 107. At point 107, it is discriminated whether the throttle-position switch 50 is on or off. If it is discriminated that the throttle-position switch 50 is on, in other words, that the throttle valve 20 is in the idle position, the program proceeds to point 108, where present enrichment-correction factor WL is reduced, by a first constant $K_1$. Namely, at point 108, the calculation $WL \leftarrow WL - K_1$ is executed. Reduced enrichment-correction factor WL is stored in the RAM 78 again. Contrary to this, if it is discriminated that the throttle-position switch 50 is off, in other words, that the throttle valve 20 is not in the idle position, the program proceeds to point 109, where present enrichment-correction factor WL is reduced by a second constant $K_2$ Namely, at point 109, the calculation $WL \leftarrow WL - K_2$ is executed. Reduced enrichment-correction factor WL is stored in the RAM 78 again. The above first constant $K_1$ is surely smaller than the second constant $K_2 (K_1 < K_2)$.

As a result of repeatedly executing the process of FIG. 8, the decrease speed of warm-up enrichment correction factor WL after starting of the engine is controlled so that it is slow when the throttle valve 20 is in the idle position and fast when throttle valve 20 is in the open position.

Figure 9:
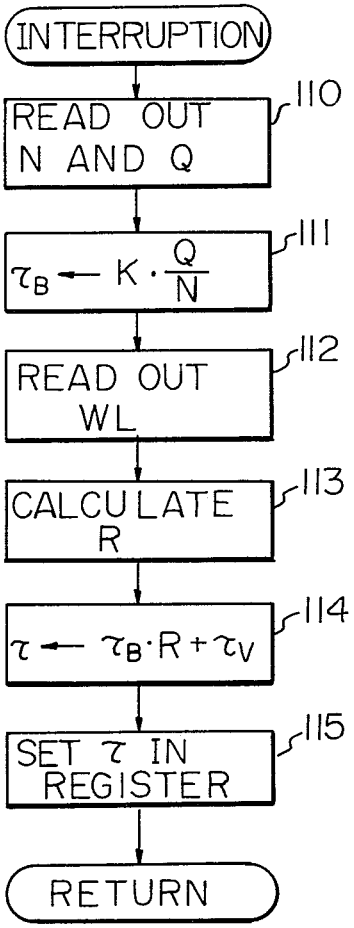

The MPU 72 executes the processing routine of FIG. 9 for the arithmetic calculation of the fuel-injection pulse width when interruption request occurs at a predetermined crank-angle position. First, at point 110, the MPU 72 reads out intake-air flow-rate data Q and engine rpm data N from the RAM 78. Next, at point 111, the MPU 72 calculates a basic pulse width of $\tau_B$ from the algebraic equation $$\tau_B = K \cdot \frac{Q}{N}$$

where K is a constant. Then, at point 112, the MPU 72 reads out enrichment-correction factor WL calculated and stored in the RAM 78 in the processing routine of FIG. 8. At point 113, total enrichment-correction factor R is calculated from warm-up enrichment correction factor WL, acceleration enrichment-correction factor ACE, and another enrichment-correction factor R. That is, total enrichment-correction factor R is calculated from the equation $$R = WL \cdot (ACE + \alpha + 1.0).$$

At point 114, a final fuel-injection pulse width of $\tau$ is calculated from the algebraic equation $$\tau = \tau_B \cdot R + \tau_V$$

where $\tau_V$ is a value that corresponds to the ineffective injection pulse width of the fuel-injection valves.

The data which corresponds to the thus-calculated pulse width of $\tau$ is set, at point 115, to the register in the I/O unit 76, whereby the interrupt processing routine is finished and the program returns to the main processing routine.

The functions and effects of the latter embodiment of FIG. 7 are almost the same as those of the former embodiment of FIG. 2 except that, according to the embodiment of FIG. 7, the difference between the enrichment characteristics of $WL_{ST}$ and $WL_N$ is not fixed by varies depending upon the change of coolant temperature THW. In other words, according to the latter embodiment of FIG. 7, starting-enrichment factor $WL_{ST}$ changes in accordance with coolant temperature THW independent of normal warm-up enrichment factor $WL_N$.

As illustrated in detail in the foregoing, according to the present invention, the transfer speed of two-characteristic enrichment correction after engine starting is selectively changed depending on whether the throttle valve is in the idle position or not. Accordingly, the air-fuel ratio of the air-fuel mixture supplied to the engine can be controlled at a greatly leaner ratio without the operating characteristics of the engine, which extremely improve the pollution reduction performance, being unfavorable affected.

As many widely different embodiments of the present invention may be constructed without departing from the spirit and scope of the present invention, it should be understood that the present invention is not limited to the specific embodiments described in this specification, except as defined in the appended claims.

1. A method for controlling the fuel-feeding rate of an internal combustion engine having a throttle valve, comprising the steps of:

detecting the warm-up condition of the engine to generate a first electrical signal which indicates the detected warm-up condition;

detecting whether the engine is starting or is not starting to generate a second electrical signal which indicates the detected result;

detecting whether the throttle valve is in the idle position or is not in the idle position to generate a third electrical signal which indicates the detected results;

calculating, in response to said first electrical signal, a first additional increment of the fuel-feeding rate of the engine, said first additional increment being determined depending upon the detected warm-up condition;

calculating, in response to said second and third electrical signals, a second additional increment of the fuel-feeding rate of the engine, said second additional increment, after starting of the engine, being decreased to zero with the lapse of time at a controllable speed of decrease, and said speed of decrease of the second additional increment being changed depending upon the third electrical signal; and correcting the fuel-feeding rate of the engine in accordance with said calculated first and second additional increments.

2. A method as claimed in claim 1, wherein said second additional increment-calculating step includes a step of changing said speed of decrease of the second additional increment when the throttle valve is in the idle position to a speed lower than the speed when the throttle valve is not in the idle position.

3. A method as claimed in claim 1 or 2, wherein said second additional increment calculating step includes a step of calculating, in response to the first and second electrical signals, a second additional increment of the fuel-feeding rate during starting of the engine, said second additional increment during starting of the engine being determined depending upon the detected warm-up condition.

4. An apparatus for controlling the fuel-feeding rate of an internal combustion engine having a throttle valve, comprising:

means for detecting the warm-up condition of the engine to generate a first electrical signal which indicates the detected warm-up condition;

means for detecting whether the engine is starting or not starting to generate a second electrical signal which indicates the detected result;

means for detecting whether the throttle valve is in the idle position or not to generate a third electrical signal which indicates the detected result;

means for calculating, in response to said first electrical signal, a first additional increment of the fuel-feeding rate of the engine, said first additional increment being determined depending upon the detected warm-up condition;

means for calculating, in response to said second and third electrical signals, a second additional increment of the fuel-feeding rate of the engine, said second additional increment, after starting of the engine, being decreased to zero with the lapse of time at a controllable speed of decrease, and said speed of decrease of the second additional increment being changed depending upon the third electrical signal; and means for correcting the fuel-feeding rate of the engine in accordance with said calculated first and second additional increments.

5. An apparatus as claimed in claim 4, wherein said second additional increment-calculating means includes means for changing said speed of decrease of the second additional increment when the throttle valve is in the idle position to a speed lower than the speed when the throttle valve is not in the idle position.

6. An apparatus as claimed in claim 4 or 5, wherein said second additional increment calculating means includes means for calculating, in response to the first and second electrical signals, a second additional increment of the fuel-feeding rate during starting of the engine, said second additional increment during starting of the engine being determined depending upon the detected warm-up condition.

7. An apparatus for controlling the fuel feeding rate of an internal combustion engine having a throttle valve and a starter switch, comprising:

means for detecting the warm-up condition of the engine to generate a first electrical signal which indicates the detected warm-up condition;

first circuit means for producing a warm-up increment signal depending upon the first electrical signal;

second circuit means for producing a starting-increment signal of a fixed value when the starter switch is closed and for producing a starting-increment signal which decreases with the lapse of time at a controllable speed of decrease when the starter switch is opened;

means for additionally increasing the fuel-feeding rate of the engine in response to the warm-up increment signal and the starting-increment signal;

throttle-position sensing means for detecting the position of the throttle valve to generate a second electrical signal when the throttle valve is in the idle position; and third circuit means for changing the speed of decrease of said starting-increment signal after starting of the engine when the second electrical signal is generated to a speed lower than the speed when the second electrical signal is not generated.

8. An apparatus as claimed in claim 7, wherein said second circuit means includes an integration circuit for holding an initial value, when the starter switch is closed and for gradually decreasing the initial value when the starter switch is open.

9. An apparatus as claimed in claim 8, wherein said third circuit means includes a switching circuit for changing the integration time constant of said integration circuit in response to the second electrical signal from the throttle position-sensing means.

* * * * *